US011011086B2

(12) United States Patent
Park et al.

(10) Patent No.: US 11,011,086 B2
(45) Date of Patent: May 18, 2021

(54) DISPLAY DEVICE PERFORMING UNEVENNESS CORRECTION AND METHOD OF OPERATING THE DISPLAY DEVICE

(71) Applicant: Samsung Display Co., Ltd., Yongin-si (KR)

(72) Inventors: Jinwoo Park, Yongin-si (KR); Eun Suk Kim, Asan-si (KR); Hoemi Kim, Asan-si (KR); Kwangyoul Lee, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/448,543

(22) Filed: Jun. 21, 2019

(65) Prior Publication Data

US 2020/0051474 A1 Feb. 13, 2020

(30) Foreign Application Priority Data

Aug. 13, 2018 (KR) ..... 10-2018-0094203

(51) Int. Cl.
*G09G 3/00* (2006.01)
*G09G 3/36* (2006.01)

(52) U.S. Cl.
CPC ..... *G09G 3/006* (2013.01); *G09G 3/3607* (2013.01); *G09G 3/3688* (2013.01); *G09G 3/3696* (2013.01); *G09G 2320/0233* (2013.01)

(58) Field of Classification Search
CPC .... G09G 3/006; G09G 3/3607; G09G 3/3688; G09G 3/3696; G09G 2320/0233
See application file for complete search history.

(56) References Cited

U.S. PATENT DOCUMENTS 10,121,408 B2 * 11/2018 Deng ..... G09G 3/2074
2005/0007392 A1 * 1/2005 Kasai ..... G09G 3/3275 345/690

(Continued)

FOREIGN PATENT DOCUMENTS

KR 10-2015-0081104 A 7/2015
KR 10-2016-0128538 A 11/2016
KR 10-2017-0087558 A 7/2017

*Primary Examiner* — Ariel A Balaoing
(74) *Attorney, Agent, or Firm* — Lewis Roca Rothgerber Christie LLP

(57) ABSTRACT

A display device includes a display panel including a plurality of pixels, a power management circuit configured to generate an analog driving voltage, a correction data memory configured to store a plurality of unevenness correction data sets respectively corresponding to a plurality of analog driving voltage ranges, a controller configured to determine, among the plurality of analog driving voltage ranges, a current analog driving voltage range to which the analog driving voltage output from the power management circuit belongs, to select an unevenness correction data set corresponding to the current analog driving voltage range from the plurality of unevenness correction data sets stored in the correction data memory, and to correct image data based on the selected unevenness correction data set, and a source driver configured to receive the corrected image data from the controller, and to provide the plurality of pixels with data voltages corresponding to the image data.

20 Claims, 7 Drawing Sheets

(56) References Cited

U.S. PATENT DOCUMENTS

| | | | | |
|---|---|---|---|---|
| 2008/0036715 | A1* | 2/2008 | Lee | G09G 3/006 345/87 |
| 2008/0088550 | A1* | 4/2008 | Kim | H05B 45/37 345/82 |
| 2008/0284794 | A1* | 11/2008 | Wang | G09G 3/3688 345/618 |
| 2011/0012908 | A1* | 1/2011 | Daly | G09G 3/006 345/581 |
| 2014/0320521 | A1* | 10/2014 | Oh | G09G 3/3225 345/601 |
| 2014/0354704 | A1* | 12/2014 | Pak | G09G 3/3291 345/690 |
| 2015/0206485 | A1* | 7/2015 | Kim | G09G 3/3607 345/690 |
| 2016/0027382 | A1* | 1/2016 | Chaji | G09G 3/3233 345/212 |
| 2018/0166030 | A1* | 6/2018 | Liu | G09G 3/20 |
| 2019/0066555 | A1* | 2/2019 | Gu | G09G 3/3225 |
| 2019/0340965 | A1* | 11/2019 | Chang | G09G 3/3233 |

* cited by examiner

DISPLAY DEVICE PERFORMING UNEVENNESS CORRECTION AND METHOD OF OPERATING THE DISPLAY DEVICE

CROSS-REFERENCE TO RELATED APPLICATION

This application claims priority to and the benefit of Korean Patent Applications No. 10-2018-0094203, filed on Aug. 13, 2018 in the Korean Intellectual Property Office (KIPO), the content of which is incorporated herein in its entirety by reference.

BACKGROUND

1. Field

Aspects of some example embodiments relate generally to display devices.

2. Description of the Related Art

In a display device, such as a liquid crystal display (LCD) device, a plurality of pixels of the display device may have difference luminance due to a characteristic variation between the pixels, a manufacturing process variation, etc. For example, in a thin film pattern forming process, thin film patterns may be formed to have different widths due to an exposure amount variation, and thus a parasitic capacitance variation between transistors and/or a parasitic capacitance variation between signal lines may occur. These variations may cause the pixels to have different luminances, which results in luminance unevenness or a mura defect in a display panel and deterioration of image quality.

To correct the luminance unevenness or the mura defect, after a display panel is manufactured and before the display panel is sold as a product, an automatic test process is performed for the display panel or the display device. The automatic test process may include an unevenness (or mura) correction test operation that captures a test image displayed by the display panel, obtains luminance distribution data for the display panel based on the captured test image, and generates unevenness correction data based on the luminance distribution data. The unevenness correction data generated by the unevenness correction test operation may be stored in the display device, and the display device may correct image data based on the stored unevenness correction data to display an image where the luminance unevenness or the mura defect is corrected.

However, a test control board is used when the automatic test process is performed, and, after the automatic test process, or after the display panel in a module state is sold, another control board may be used in the display device instead of the test control board. In this case, an analog driving voltage output from the test control board and an analog driving voltage output from the another control board may have different voltage levels, and thus the unevenness correction data generated using the test control board may be unsuitable for the display device including the another control board.

The above information disclosed in this Background section is only for enhancement of understanding of the background of the invention and therefore it may contain information that does not constitute prior art.

SUMMARY

Aspects of some example embodiments relate generally to display devices. For example, some example embodiments relate to display devices performing unevenness correction and methods of operating the display devices.

Some example embodiments provide a display device capable of accurately performing unevenness correction and improving an image quality.

Some example embodiments provide a method of operating a display device capable of accurately performing unevenness correction and improving an image quality.

According to some example embodiments, there is provided a display device including a display panel including a plurality of pixels, a power management circuit configured to generate an analog driving voltage, a correction data memory configured to store a plurality of unevenness correction data sets respectively corresponding to a plurality of analog driving voltage ranges, a controller configured to determine, among the plurality of analog driving voltage ranges, a current analog driving voltage range to which the analog driving voltage output from the power management circuit belongs, to select an unevenness correction data set corresponding to the current analog driving voltage range from the plurality of unevenness correction data sets stored in the correction data memory, and to correct image data based on the selected unevenness correction data set, and a source driver configured to receive the corrected image data from the controller, and to provide the plurality of pixels with data voltages corresponding to the corrected image data.

In some example embodiments, the display device may further include a control board on which the power management circuit and the controller are located.

In some example embodiments, the display device may further include a source board on which the correction data memory is located.

In some example embodiments, the source board may be connected to a test control board on which a test power management circuit and a test controller are located during an automatic test process for the display device, and may be connected to the control board instead of the test control board after the automatic test process.

In some example embodiments, the automatic test process may include a plurality of unevenness correction test operations respectively corresponding to the plurality of analog driving voltage ranges, and the plurality of unevenness correction data sets may be generated by the plurality of unevenness correction test operations, respectively.

In some example embodiments, the display device may further include a first film configured to connect the control board and the source board.

In some example embodiments, the display device may further include a second film configured to connect the source board and the display panel.

In some example embodiments, the source driver may be implemented as a source driver integrated circuit located on the second film.

In some example embodiments, each of the plurality of unevenness correction data sets may include correction data values respectively corresponding to entire gray levels with respect to each of the plurality of pixels.

In some example embodiments, the controller may correct the image data by converting values of the image data to the correction data values of the selected unevenness correction data set.

In some example embodiments, the controller may include a comparator configured to compare the analog driving voltage output from the power management circuit with at least one reference voltage corresponding to a boundary between the plurality of analog driving voltage ranges, a correction data selector configured to select the unevenness correction data set corresponding to the current analog driving voltage range based on a result of the comparison by the comparator, and to read the selected unevenness correction data set from the correction data memory, and an image data corrector configured to correct the image data based on the selected unevenness correction data set output from the correction data selector.

In some example embodiments, the power management circuit may include a DC-DC converter configured to convert an input voltage into the analog driving voltage, and a gamma reference voltage generator configured to generate a gamma reference voltage based on the analog driving voltage.

In some example embodiments, the source driver may generate gray voltages respectively corresponding to entire gray levels based on the gamma reference voltage, and may output, as the data voltages, the gray voltages corresponding to gray levels indicated by the corrected image data.

In some example embodiments, the power management circuit may further include a common voltage generator configured to generate a common voltage based on the analog driving voltage, and a gate driving voltage generator configured to generate a gate driving voltage based on the analog driving voltage.

According to some example embodiments, there is provided a method of operating a display device. In the method, an analog driving voltage is generated, a current analog driving voltage range to which the analog driving voltage belongs is determined among a plurality of analog driving voltage ranges, an unevenness correction data set corresponding to the current analog driving voltage range is selected from a plurality of unevenness correction data sets stored in a correction data memory, image data are corrected based on the selected unevenness correction data set, and a plurality of pixels are provided with data voltages corresponding to the corrected image data.

In some example embodiments, the correction data memory may be located on a source board.

In some example embodiments, the source board may be connected to a test control board on which a test power management circuit and a test controller are located, and an automatic test process for the display device may be performed.

In some example embodiments, the automatic test process may include a plurality of unevenness correction test operations respectively corresponding to the plurality of analog driving voltage ranges, and the plurality of unevenness correction data sets may be generated by the plurality of unevenness correction test operations, respectively.

In some example embodiments, the source board may be connected to a control board instead of the test control board after the automatic test process.

In some example embodiments, each of the plurality of unevenness correction data sets may include correction data values respectively corresponding to entire gray levels with respect to each of the plurality of pixels.

As described above, in the display device and the method of operating the display device according to some example embodiments, a correction data memory may store a plurality of unevenness correction data sets respectively corresponding to a plurality of analog driving voltage ranges, and a controller may correct image data based on the unevenness correction data set suitable for an analog driving voltage output from a power management circuit. Accordingly, although any one of control boards that output analog driving voltages having different voltage levels is used in the display device, unevenness correction may be accurately performed, and image quality may be improved.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
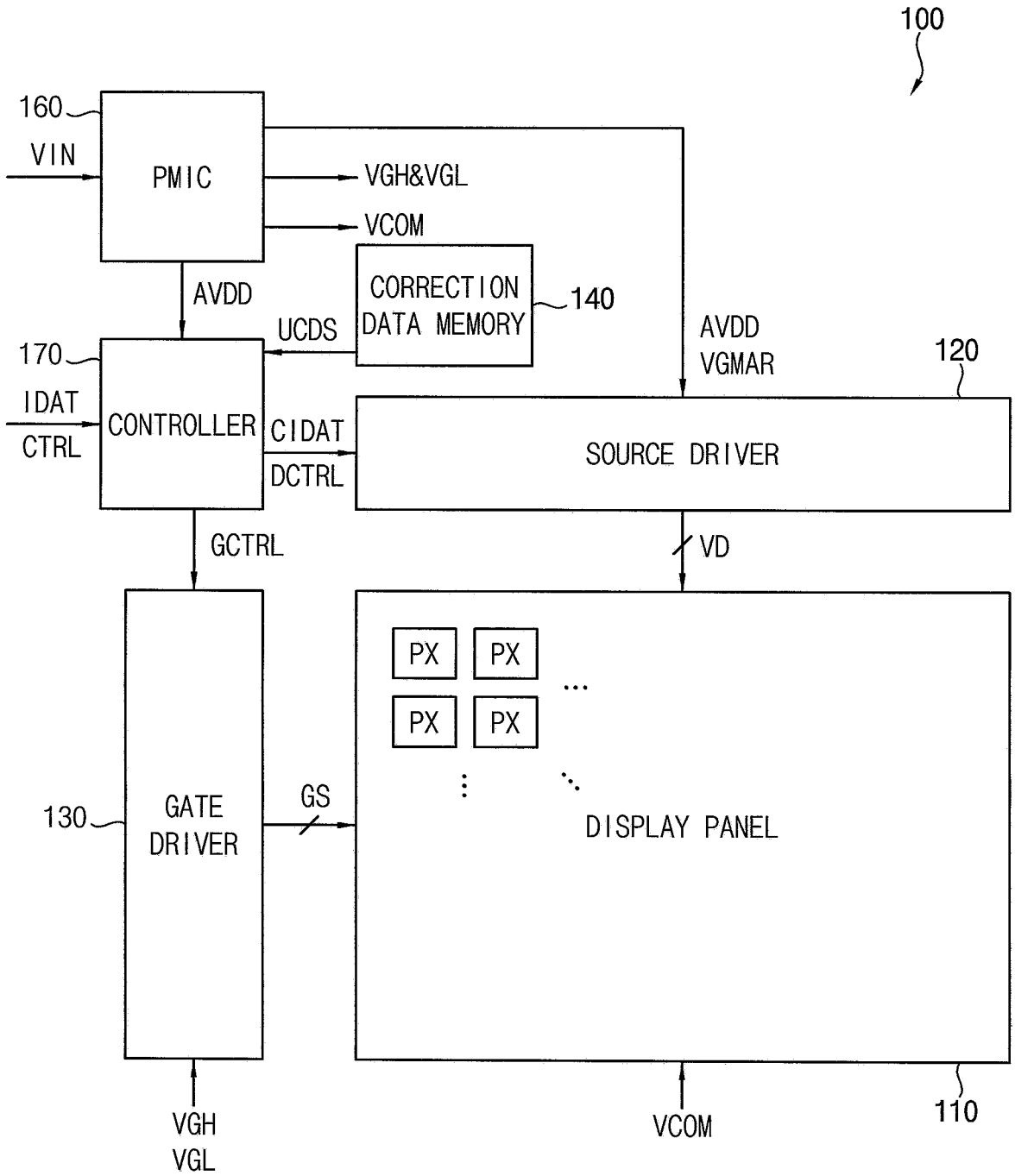
FIG. 1 is a block diagram illustrating a display device according to some example embodiments.

The example embodiments are described more fully hereinafter with reference to the accompanying drawings. Like or similar reference numerals refer to like or similar elements throughout.

Figure 2:
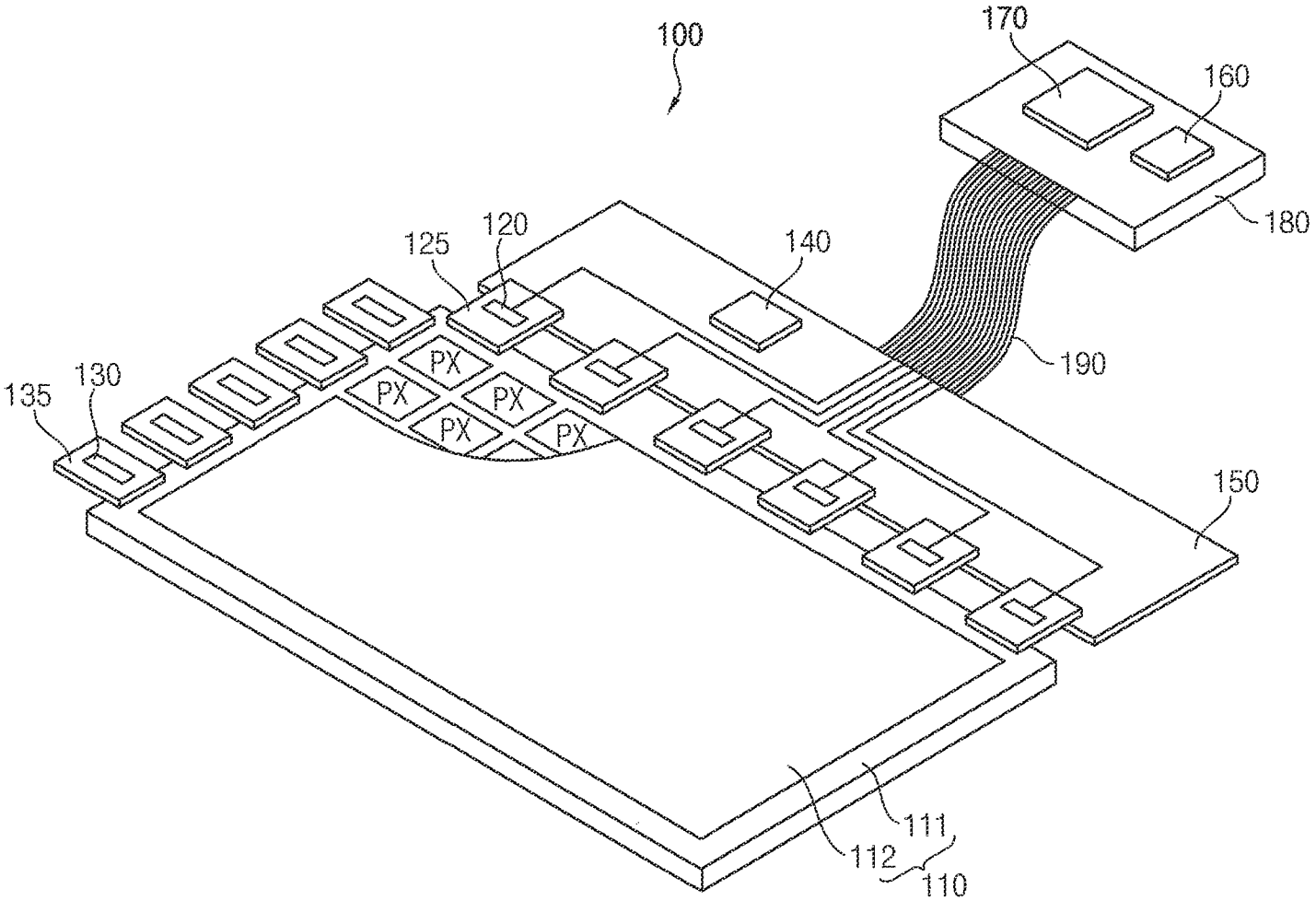
FIG. 2 is a diagram illustrating an example of a display device according to some example embodiments.
Figure 3:
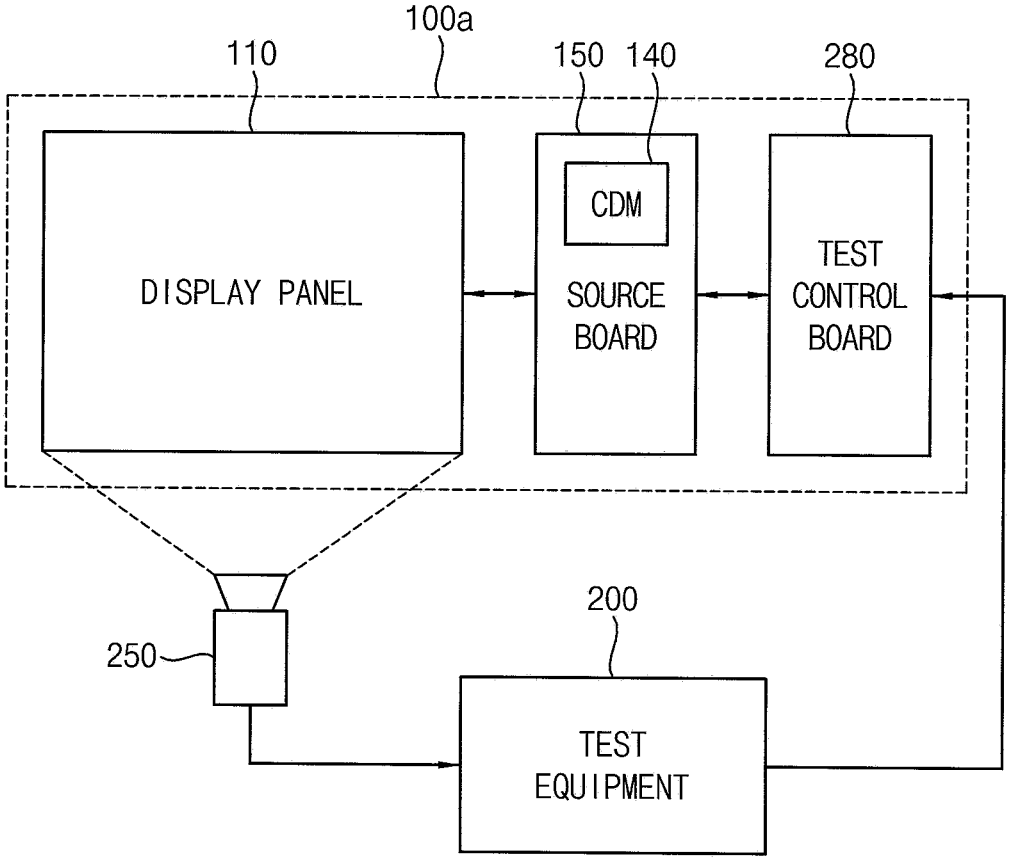
FIG. 3 is a diagram illustrating an example of an automatic test process for a display device according to some example embodiments.
Figure 4:
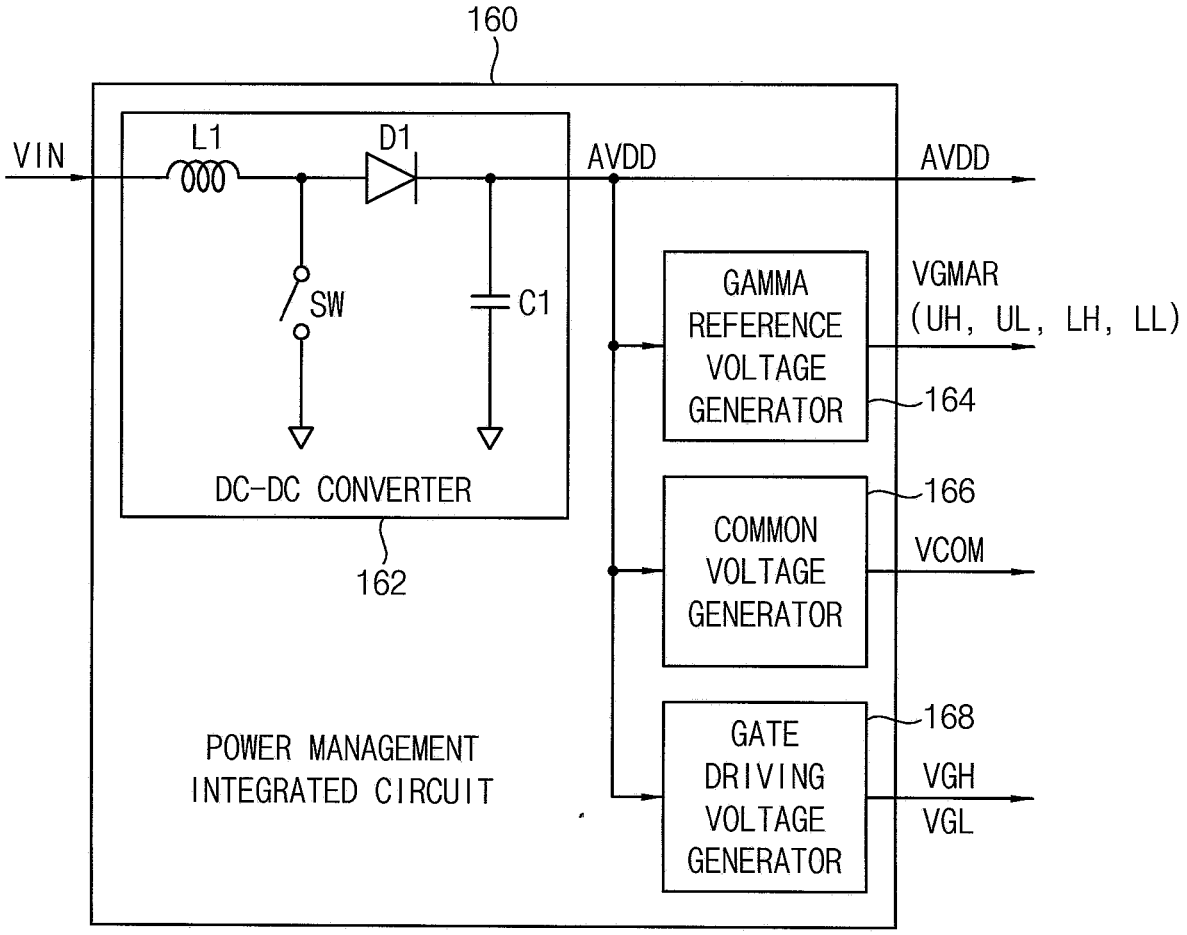
FIG. 4 is a block diagram for describing an example of a power management circuit included in a display device of FIG. 1.
Figure 5:
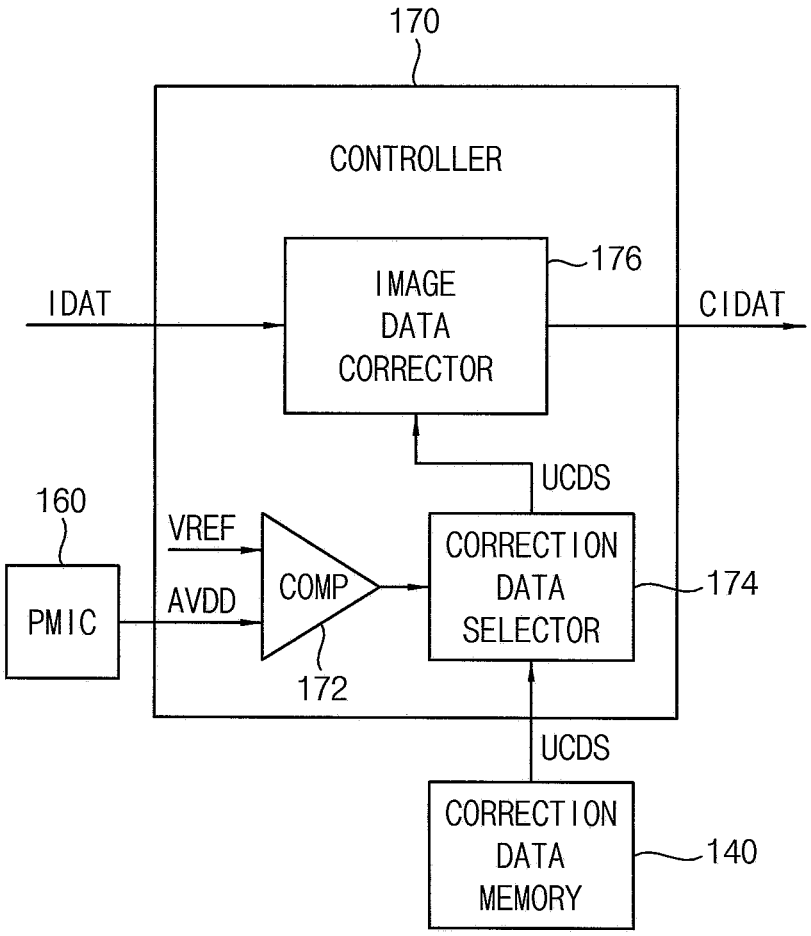
FIG. 5 is a block diagram for describing an example of a controller included in a display device of FIG. 1.

FIG. 1 is a block diagram illustrating a display device according to some example embodiments, FIG. 2 is a diagram illustrating an example of a display device according to some example embodiments, FIG. 3 is a diagram illustrating an example of an automatic test process for a display device according to some example embodiments, FIG. 4 is a block diagram for describing an example of a power management circuit included in a display device of FIG. 1, and FIG. 5 is a block diagram for describing an example of a controller included in a display device of FIG. 1.

Referring to FIG. 1, a display device 100 may include a display panel 110, a source driver 120, a gate driver 130, a correction data memory 140, a power management circuit 160 and a controller 170.

The display panel 110 may include a plurality of data lines, a plurality of gate lines, and a plurality of pixels PX connected to the plurality of data lines and the plurality of gate lines. In some example embodiments, each pixel PX may include a switching transistor and a liquid crystal capacitor connected to the switching transistor, and the display panel 110 may be a liquid crystal display (LCD) panel. However, the display panel 110 may not be limited to the LCD panel, and may be any display panel. Further, in some example embodiments, as illustrated in FIG. 2, the display panel 110 may include, but embodiments are not limited to, a lower substrate 111 on which the plurality of data lines, the plurality of gate lines and a pixel circuit element, such as a transistor, are located, and a color filter substrate 112 opposed to the lower substrate 111.

The source driver 120 may generate data voltages VD based on image data CIDAT and a data control signal DCTRL output from the controller 170, and may provide the data voltages VD to the plurality of pixels PX. For example, the data control signal DCTRL may include, but not limited to, a horizontal start signal and a load signal.

In some example embodiments, as illustrated in FIG. 2, the display device 100 may further include a source board (e.g., a source printed circuit board (PCB) or a source printed board assembly (PBA)) 150 on which the correction data memory 140 is located, and a second film 125 connecting the source board 150 and the display panel 110. In some example embodiments, the source driver 120 may be implemented as a source driver integrated circuit (IC) 120 located or mounted on the second film 125. For example, the second film 125 may be a flexible film 125, and the source driver IC 120 may be mounted on the flexible film 125 in a chip on film (COF) manner or a tape automated bonding (TAB) manner. Further, in some example embodiments, as illustrated in FIG. 2, the display device 100 may include one or more source driver ICs 120. Although FIG. 2 illustrates an example where the display device 100 includes one source board 150, in some example embodiments, the display device 100 may include two or more source boards 150 of which each is connected to one or more flexible films 125.

The gate driver 130 may generate gate signals GS based on a gate control signal GCTRL output from the controller 170, and may provide the gate signals GS to the plurality of pixels PX. For example, the gate control signal GCTRL may include, but not limited to, a gate clock signal and a gate start signal.

In some example embodiments, as illustrated in FIG. 2, the gate driver 130 may be implemented in a form of a gate driver IC 130 mounted on a flexible film 135 attached to the display panel 110. For example, the gate driver IC 130 may be mounted on the flexible film 135 in the COF manner or the TAB manner. In other example embodiments, the gate driver 130 may be mounted in the form of the gate driver IC 130 on the lower substrate 111 in a chip on glass (COG) manner, or may be implemented as an amorphous silicon gate (ASG) driver integrated on the lower substrate 111. Further, in some example embodiments, as illustrated in FIG. 2, the display device 100 may include one or more gate driver ICs 130.

The correction data memory 140 may store a plurality of unevenness correction data sets respectively corresponding to a plurality of analog driving voltage ranges. For example, the correction data memory 140 may store, but not limited to, a first unevenness correction data set suitable for a case where an analog driving voltage AVDD belongs to a first analog driving voltage range from about 14.8V to about 14.9V, a second unevenness correction data set suitable for a case where the analog driving voltage AVDD belongs to a second analog driving voltage range from about 15.0V to about 15.1V, and a third unevenness correction data set suitable for a case where the analog driving voltage AVDD belongs to a third analog driving voltage range from about 15.2V to about 15.3V. In some example embodiments, as illustrated in FIG. 2, the correction data memory 140 may be located on the source board 150 connected to the display panel 110 through the second film 125. Further, in some example embodiments, the correction data memory 140 may be implemented with a nonvolatile memory device, such as a flash memory device, that retains stored data even while the display device 100 is not supplied with power.

In some example embodiments, the plurality of unevenness correction data sets stored in the correction data memory 140 may be generated by an automatic test process (e.g., an automatic manual test (AMT) process) for the display device 100. For example, as illustrated in FIG. 3, after the display panel 110 is manufactured and the source board 150 is connected to the display panel 110, the automatic test process for the display device (e.g., the display device in a module state before the control board is connected to the source board 150) 100*a* may be performed using a test equipment 200. While the automatic test process is performed, a test control board 280 on which a test power management circuit and a test controller are located may be connected to the source board 150.

The automatic test process performed by the test equipment 200 may include an unevenness (or mura) correction test operation that provides test image data to the display device 100*a*, captures an image displayed at the display panel 110 based on the test image data using a camera (e.g., a charge coupled device (CCD) camera) 250, obtains luminance distribution data for the display panel 110 based on the captured image, and generates the unevenness correction data set based on the luminance distribution data. The test equipment 200 may write the unevenness correction data set generated by the unevenness correction test operation to the correction data memory 140 located on the source board 150. In some example embodiments, the unevenness correction data set may include correction data values respectively corresponding to entire gray levels (e.g., 256 gray levels from 0-gray level to 255-gray level) with respect to each of the plurality of pixels PX.

The automatic test process for the display device 100 according to some example embodiments may include a plurality of unevenness correction test operations that respectively correspond to the plurality of analog driving voltage ranges and that respectively generate the plurality of unevenness correction data sets. For example, a first unevenness correction test operation generating the first unevenness correction data set may be performed by controlling the test power management circuit of the test control board 280 to generate the analog driving voltage AVDD within the first analog driving voltage range from about 14.8V to about 14.9V, a second unevenness correction test operation generating the second unevenness correction data set may be performed by controlling the test power management circuit of the test control board 280 to generate the analog driving voltage AVDD within the second analog driving voltage range from about 15.0V to about 15.1V, and a third unevenness correction test operation generating the third unevenness correction data set may be performed by controlling the test power management circuit of the test control board 280 to generate the analog driving voltage AVDD within the third analog driving voltage range from about 15.2V to about 15.3V. The plurality of unevenness correction data sets generated by the plurality of unevenness correction test operations for the display device 100 according to example embodiments may be stored in the correction data memory 140 of the display device 100. After the automatic test process, or, for example, when the display device 100*a* in the module state is assembled to the display device 100 as a final product, the source board 150 may be connected to a control board 180 illustrated in FIG. 2 instead of the test control board 280. In some example embodiments, as illustrated in FIG. 2, the source board 150 and the control board 180 may be connected to each other through a first film 190. For example, the first film 190 may be a flexible flat cable (FFC), a flexible printed circuit (FPC), or the like.

The power management circuit 160 may generate the analog driving voltage AVDD provided to the source driver 120. The power management circuit 160 may further generate a gamma reference voltage VGMAR, a common voltage VCOM and a gate driving voltage VGH and VGL based on the analog driving voltage AVDD. In some example embodiments, as illustrated in FIG. 2, the power management circuit 160 may be implemented as a power management integrated circuit (PMIC) 160 located on the control board (e.g., a control PCB or a control PBA) 180 where the controller 170 is located.

In some example embodiments, as illustrated in FIG. 4, the power management circuit 160 may include a DC-DC converter 162 that converts an input voltage VIN supplied from an external host into the analog driving voltage AVDD. For example, the DC-DC converter 162 may include an inductor L1, a switching element SW, a diode D1 and a capacitor C1, and may be, but not limited to, a boost converter that boosts the input voltage VIN to the analog driving voltage AVDD. The analog driving voltage AVDD may be provided to the source driver 120, and the source driver 120 may operate based on the analog driving voltage AVDD. Further, the analog driving voltage AVDD output from the power management circuit 160 may be provided to the controller 170 to determine a current analog driving voltage range to which the analog driving voltage AVDD belongs.

The power management circuit 160 may further include a gamma reference voltage generator 164 that generates the gamma reference voltage VGMAR based on the analog driving voltage AVDD. For example, the gamma reference voltage generator 164 may generate, as the gamma reference voltage VGMAR, but not limited to, a positive high (or upper-high) gamma reference voltage UH having the highest voltage level, a negative low (or lower-low) gamma reference voltage LL having the lowest voltage level, and a positive low (or upper-low) gamma reference voltage UL and a negative high (or lower-high) gamma reference voltage LH having voltage levels between the positive high gamma reference voltage UH and the negative low gamma reference voltage LL. The gamma reference voltage VGMAR generated by the gamma reference voltage generator 164 may be provided to the source driver 120. The source driver 120 may generate gray voltages (e.g., 256 gray voltages) respectively corresponding to the entire gray levels (e.g., 256 gray levels from 0-gray level to 255-gray level) based on the gamma reference voltage VGMAR, and may output, as the data voltages VD, the gray voltages corresponding to gray levels indicated by the image data CIDAT output from the controller 170.

The power management circuit 160 may further include a common voltage generator 166 that generates the common voltage VCOM based on the analog driving voltage AVDD, and a gate driving voltage generator 168 that generates the gate driving voltage VGH and VGL based on the analog driving voltage AVDD. The common voltage VCOM generated by the common voltage generator 166 may be applied to a common electrode of the display panel 110, and the gate driving voltage VGH and VGL, for example a high gate voltage VGH and a low gate voltage VGL generated by the gate driving voltage generator 168 may be provided to the gate driver 130. The gate driver 130 may generate the gate signals GS based on the high gate voltage VGH and the low gate voltage VGL.

The controller 170 may receive image data IDAT and a control signal CTRL from an external host (e.g., a graphic processing unit (GPU) or a graphic card). In some example embodiments, the image data IDAT may be RGB data including red image data, green image data and blue image data. In some example embodiments, the control signal CTRL may include, but not limited to, a data enable signal, a master clock signal, a vertical synchronization signal and a horizontal synchronization signal. The controller 170 may generate the data control signal DCTRL, the gate control signal GCTRL and output image data CIDAT based on the image data IDAT and the control signal CTRL. The controller 170 may control an operation of the source driver 120 by providing the data control signal DCTRL and the output image data CIDAT to the source driver 120, and may control an operation of the gate driver 130 by providing the gate control signal GCTRL to the gate driver 130. In some example embodiments, the controller 170 may be a timing controller (TCON). Further, in some example embodiments, the controller 170 may be located on the control board (e.g., the control PCB or the control PBA) 180 where the power management circuit 160 is located.

In the display device 100 according to example embodiments, the controller 170 may determine, among the plurality of analog driving voltage ranges, a current analog driving voltage range to which the analog driving voltage AVDD output from the power management circuit 160 belongs, may select an unevenness correction data set UCDS corresponding to the current analog driving voltage range from the plurality of unevenness correction data sets stored in the correction data memory 140, and may correct image data IDAT based on the selected unevenness correction data set UCDS. The controller 170 may generate the corrected image data CIDAT by converting values of the image data IDAT to the correction data values of the selected unevenness correction data set UCDS. The source driver 120 may receive the corrected image data CIDAT from the controller 170, and may provide the plurality of pixels PX with the data voltages VD corresponding to the corrected image data CIDAT.

In some example embodiments, to generate the corrected image data CIDAT based on the selected unevenness correction data set UCDS suitable for the analog driving voltage AVDD, the controller 170 may include, as illustrated in FIG. 5, a comparator 172 that compares the analog driving voltage AVDD output from the power management circuit 160 with at least one reference voltage VREF corresponding to a boundary between the plurality of analog driving voltage ranges, a correction data selector 174 that selects the unevenness correction data set UCDS corresponding to the current analog driving voltage range based on a result of the comparison by the comparator 172, and that reads the selected unevenness correction data set UCDS from the correction data memory 140, and an image data corrector 176 that corrects the image data IDAT based on the selected unevenness correction data set UCDS output from the correction data selector 174. Accordingly, the display device 100 may accurately perform unevenness (or mura) correction based on the unevenness correction data set UCDS suitable for the analog driving voltage AVDD output from the power management circuit 160.

An unevenness correction test operation may be performed only once in an automatic test process for a related-art display device. Thus, the related-art display device may store only one unevenness correction data set. Further, voltage levels of an analog driving voltage and a gamma reference voltage output from a test power management circuit of a test control board used during the automatic test process may be different from voltage levels of an analog driving voltage and a gamma reference voltage output from a power management circuit of a control board included in a final display device. In this case, because the unevenness correction data set is generated based on the analog driving voltage and the gamma reference voltage of the test control board, the unevenness correction data set may be unsuitable for the final display device including the control board outputting the analog driving voltage and the gamma reference voltage having different voltage levels from those of the test control board, and the display device may not accurately perform the unevenness correction.

However, in the display device 100 according to example embodiments, the correction data memory 140 may store the plurality of unevenness correction data sets respectively corresponding to the plurality of analog driving voltage ranges, and the controller 170 may select the unevenness correction data set UCDS suitable for the analog driving voltage AVDD output from the power management circuit 160 from the plurality of unevenness correction data sets, and may correct the image data IDAT based on the selected unevenness correction data set UCDS. Accordingly, although any one of control boards outputting analog driving voltages AVDD having different voltage levels is used in the display device 100, the unevenness correction may be accurately performed, and an image quality may be improved.

Figure 6:
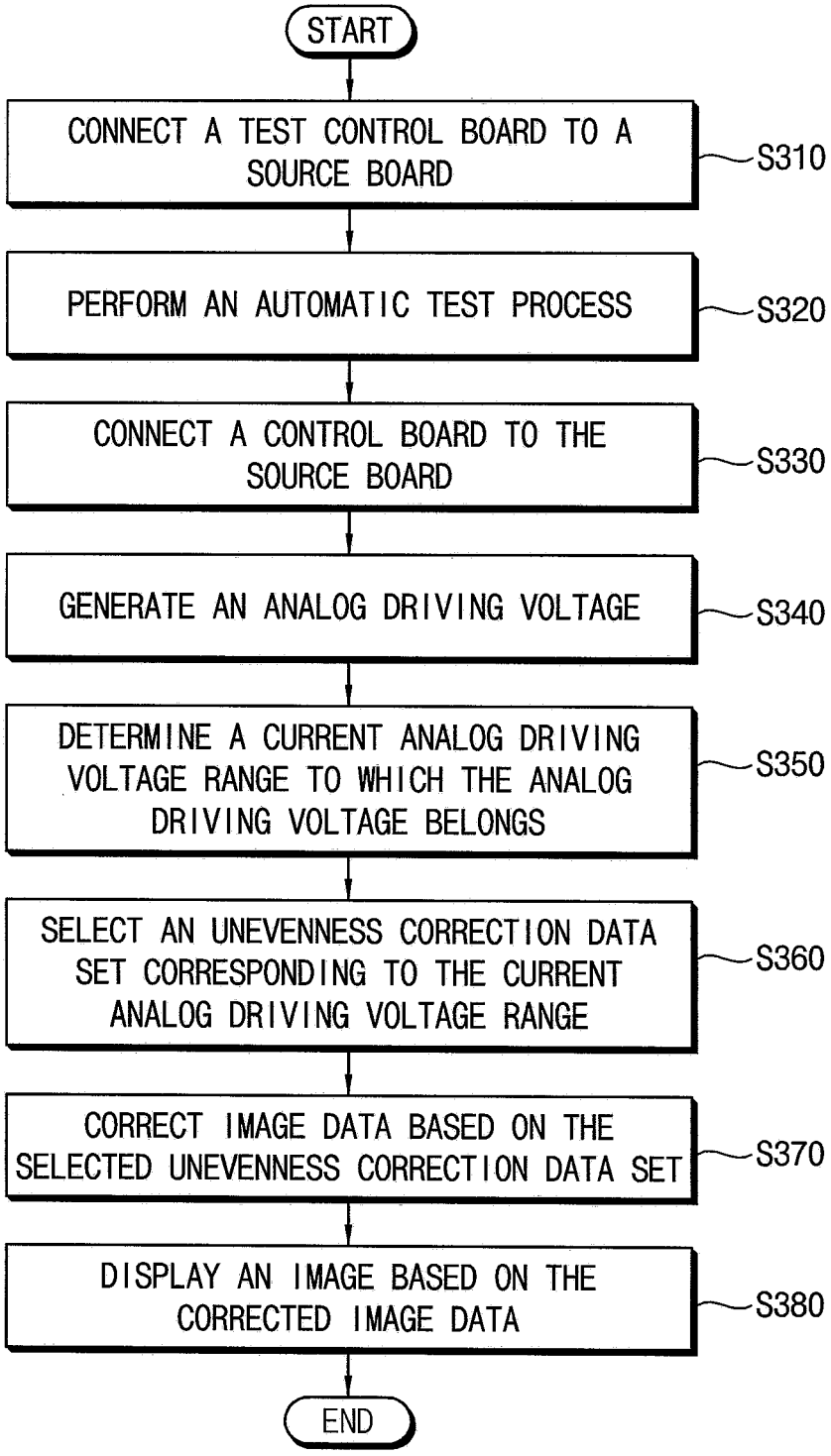
FIG. 6 is a flowchart illustrating a method of operating a display device according to some example embodiments.

FIG. 6 is a flowchart illustrating a method of operating a display device according to example embodiments.

Referring to FIGS. 1, 2 and 6, a source board 150 on which a correction data memory 140 is located may be connected to a test control board instead of a control board 180 (S310), and an automatic test process for a display device (e.g., a display device in a module state) 100 may be performed (S320). The automatic test process may include a plurality of unevenness correction test operations respectively corresponding to a plurality of analog driving voltage ranges. The plurality of unevenness correction test operations may generate a plurality of unevenness correction data sets respectively corresponding to the plurality of analog driving voltage ranges. The plurality of unevenness correction data sets generated by the automatic test process may be stored in the correction data memory 140.

After the automatic test process, the source board 150 may be connected to the control board 180 instead of the test control board (S330). For example, the display device in the module state may be sold after the test control board is detached from the source board 150, and a manufacturer purchasing the display device in the module state may assemble or manufacture the display device 100 by employing the manufacturer's own control board 180. The control board 180 may vary according to the manufacturer, and thus an analog driving voltage AVDD of a power management circuit 160 of the control board 180 may vary according to the manufacturer. That is, in the display device 100, any one of various control boards 180 outputting analog driving voltages AVDD having different voltage levels may be employed or used.

When the display device 100 operates, the power management circuit 160 may generate the analog driving voltage AVDD (S340). A controller 170 may determine a current analog driving voltage range to which the analog driving voltage AVDD belongs among the plurality of analog driving voltage ranges (S350), may select an unevenness correction data set UCDS corresponding to the current analog driving voltage range from the plurality of unevenness correction data sets stored in the correction data memory 140 (S360), and image data IDAT may be corrected based on the selected unevenness correction data set UCDS (S370). In some example embodiments, each of the plurality of unevenness correction data sets may include correction data values respectively corresponding to entire gray levels with respect to each pixel PX. A source driver 120 may receive the image data CIDAT corrected based on the selected unevenness correction data set UCDS from the controller 170, and may provide a plurality of pixels PX with data voltages VD corresponding to the corrected image data CIDAT (S380). Thus, although any one of control boards outputting analog driving voltages AVDD having different voltage levels is used in the display device 100, the display device 100 according to example embodiments may correct the image data IDAT based on the unevenness correction data set UCDS suitable for the current analog driving voltage AVDD. Accordingly, unevenness correction may be accurately performed, and an image quality may be improved.

Figure 7:
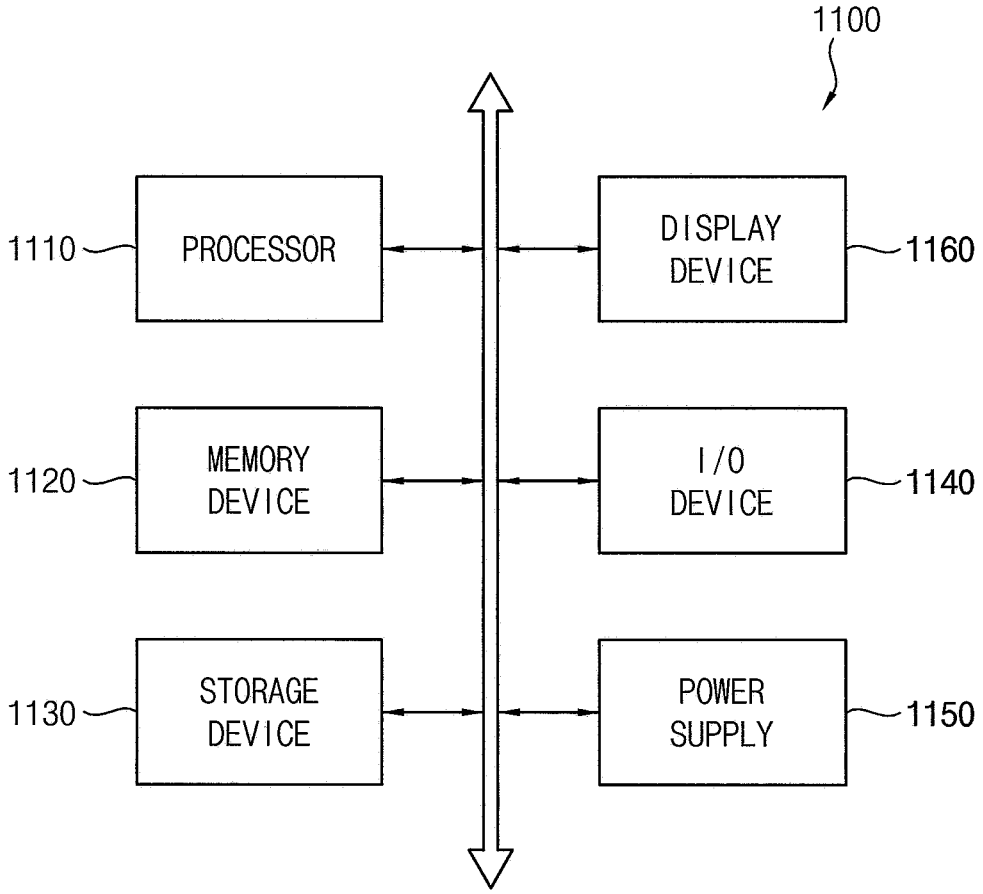
FIG. 7 is a block diagram illustrating an electronic device including a display device according to some example embodiments.

FIG. 7 is a block diagram illustrating an electronic device including a display device according to example embodiments.

Referring to FIG. 7, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100.

In the display device 1160, a correction data memory may store a plurality of unevenness correction data sets respectively corresponding to a plurality of analog driving voltage ranges, and a controller may select an unevenness correction data set suitable for a current analog driving voltage from the plurality of unevenness correction data sets, and may correct image data based on the selected unevenness correction data set. Accordingly, although any one of control boards outputting analog driving voltages having different voltage levels is used in the display device 1160, unevenness correction may be accurately performed, and an image quality may be improved.

According to example embodiments, the electronic device 1100 may be any electronic device including the display device 1160, such as a digital television, a 3D television, a cellular phone, a smart phone, a tablet computer, a wearable device, a personal computer (PC), a home appliance, a laptop computer, a personal digital assistant (PDA), a portable multimedia player (PMP), a digital camera, a music player, a portable game console, a navigation system, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels;

a power management circuit configured to generate an analog driving voltage;

a correction data memory configured to store a plurality of unevenness correction data sets respectively corresponding to a plurality of analog driving voltage ranges;

a controller configured to determine, among the plurality of analog driving voltage ranges, a current analog driving voltage range to which the analog driving voltage output from the power management circuit belongs, to select an unevenness correction data set corresponding to the current analog driving voltage range from the plurality of unevenness correction data sets stored in the correction data memory, and to correct image data based on the selected unevenness correction data set, wherein the controller includes:

a comparator configured to compare the analog driving voltage output from the power management circuit with at least one reference voltage corresponding to a boundary between the plurality of analog driving voltage ranges; and an image data corrector configured to correct the image data based on a result of the comparison by the comparator; and a source driver configured to receive the corrected image data from the controller, and to provide the plurality of pixels with data voltages corresponding to the corrected image data.

2. The display device of claim 1, further comprising:

a control board on which the power management circuit and the controller are located.

3. The display device of claim 2, further comprising:

a source board on which the correction data memory is located.

4. The display device of claim 3, wherein the source board is connected to a test control board on which a test power management circuit and a test controller are located during an automatic test process for the display device, and is connected to the control board instead of the test control board after the automatic test process.

5. The display device of claim 4, wherein the automatic test process includes a plurality of unevenness correction test operations respectively corresponding to the plurality of analog driving voltage ranges, and wherein the plurality of unevenness correction data sets are generated by the plurality of unevenness correction test operations, respectively.

6. The display device of claim 3, further comprising:

a first film configured to connect the control board and the source board.

7. The display device of claim 3, further comprising:

a second film configured to connect the source board and the display panel.

8. The display device of claim 7, wherein the source driver is implemented as a source driver integrated circuit located on the second film.

9. The display device of claim 1, wherein each of the plurality of unevenness correction data sets includes correction data values respectively corresponding to entire gray levels with respect to each of the plurality of pixels.

10. The display device of claim 9, wherein the controller corrects the image data by converting values of the image data to the correction data values of the selected unevenness correction data set.

11. The display device of claim 1, wherein the controller includes:

a correction data selector configured to select the unevenness correction data set corresponding to the current analog driving voltage range based on a result of the comparison by the comparator, and to read the selected unevenness correction data set from the correction data memory; and the image data corrector configured to correct the image data based on the selected unevenness correction data set output from the correction data selector.

12. The display device of claim 1, wherein the power management circuit includes:

a DC-DC converter configured to convert an input voltage into the analog driving voltage; and a gamma reference voltage generator configured to generate a gamma reference voltage based on the analog driving voltage.

13. The display device of claim 12, wherein the source driver is configured to generate gray voltages respectively corresponding to entire gray levels based on the gamma reference voltage, and outputs, as the data voltages, the gray voltages corresponding to gray levels indicated by the corrected image data.

14. The display device of claim 12, wherein the power management circuit further includes:

a common voltage generator configured to generate a common voltage based on the analog driving voltage; and a gate driving voltage generator configured to generate a gate driving voltage based on the analog driving voltage.

15. A method of operating a display device, the method comprising:

generating an analog driving voltage;

determining a current analog driving voltage range to which the analog driving voltage belongs among a plurality of analog driving voltage ranges;

comparing the analog driving voltage with at least one reference voltage corresponding to a boundary between the plurality of analog driving voltage ranges;

selecting an unevenness correction data set corresponding to the current analog driving voltage range from a plurality of unevenness correction data sets stored in a correction data memory;

correcting image data based on the selected unevenness correction data set and the comparison; and providing a plurality of pixels with data voltages corresponding to the corrected image data.

16. The method of claim 15, wherein the correction data memory is located on a source board.

17. The method of claim 16, further comprising:

connecting the source board to a test control board on which a test power management circuit and a test controller are located; and performing an automatic test process for the display device.

18. The method of claim 17, wherein the automatic test process includes a plurality of unevenness correction test operations respectively corresponding to the plurality of analog driving voltage ranges, and wherein the plurality of unevenness correction data sets are generated by the plurality of unevenness correction test operations, respectively.

19. The method of claim 17, further comprising:

connecting the source board to a control board instead of the test control board after the automatic test process.

20. The method of claim 15, wherein each of the plurality of unevenness correction data sets includes correction data values respectively corresponding to entire gray levels with respect to each of the plurality of pixels.

* * * * *